United States Patent [19]

Haldeman et al.

[11] 3,963,515

[45] June 15, 1976

[54] VACUUM CLEANING

[75] Inventors: Charles W. Haldeman, Concord; Eugene E. Covert, Belmont, both of Mass.

[73] Assignee: Massachusetts Institute of Technology, Cambridge, Mass.

[22] Filed: Dec. 2, 1974

[21] Appl. No.: 528,747

[52] U.S. Cl. ..... 134/21; 15/345; 15/420; 134/37

[51] Int. Cl.[2] ..... A47L 5/14

[58] Field of Search ..... 15/345, 346, 385, 393, 15/415, 420; 134/21, 37

[56] References Cited

UNITED STATES PATENTS

| | | | |
|---|---|---|---|
| 1,992,238 | 2/1935 | Rose | 15/420 |
| 2,027,543 | 1/1936 | Lofgren | 15/420 |
| 3,075,227 | 1/1963 | Bowles | 15/346 |

*Primary Examiner*—Peter Feldman
*Assistant Examiner*—C. K. Moore
*Attorney, Agent, or Firm*—Arthur A. Smith, Jr.; Charles Hieken; Martin M. Santa

[57] ABSTRACT

A new vacuum cleaning nozzle described includes a conventional vacuum cleaner suction nozzle typically used for cleaning streets or carpets and in addition short airfoils at incidence or vortex generating air nozzles supported from the nozzle and directed downward ahead of the suction nozzle to form a series of vortices for providing very high local velocities effective in dislodging debris while avoiding propelling the particles dislodged far from the suction zone.

10 Claims, 6 Drawing Figures

VACUUM CLEANING

BACKGROUND OF THE INVENTION

The present invention relates in general to vacuum cleaning and more particularly concerns novel apparatus and techniques for effectively dislodging debris, especially in hard-to-reach locations, while reducing mechanical wear and being useable on a wide variety of surfaces, including rough surfaces.

Vacuum cleaners have been widely used for many years for household and industrial cleaning. More recently, larger machines have been introduced for street sweeping. A typical prior art vacuum cleaner may include passive or driven mechanical brushes in combination with suction for removing debris.

Nozzle construction typically is nothing more than a round tube, or a round tube that flares into an elongated opening. The nozzle may terminate in a brush or other structure for dislodging debris, and the brush may be independently driven. An operator then maneuvers the nozzle over the area to be cleaned. In systems typically used for cleaning streets, the nozzle may be located just above conventional street sweeping brushes. A disadvantage of using brushes is that brushes wear out relatively rapidly and may not be effectively used except over relatively smooth, flat surfaces, such as floors, streets and carpets.

These disadvantages result in prior art systems being marginally effective in cleaning areas such as railway tracks, curbstone areas, niches and other hard-to-reach areas.

Accordingly, it is an important object of the invention to provide improved vacuum cleaning apparatus and techniques that overcome one or more of the disadvantages set forth above.

It is another object of the invention to achieve the preceding object with apparatus that is relatively inexpensive to fabricate and effectively operated by relatively unskilled personnel.

It is a further object of the invention to achieve one or more of the preceding objects with apparatus that is relatively long wearing and suitable for use in cleaning a wide variety of areas, smooth, rough or hidden.

It is a further object of the invention to achieve one or more of the preceding objects with apparatus that uses not only suction but compressed air.

It is a further object of the invention to achieve one or more of the preceding objects with apparatus arranged to provide relatively little friction between the nozzle and the surface cleaned to make cleaning relatively easy.

SUMMARY OF THE INVENTION

According to the invention, vacuum cleaning means includes nozzle means for withdrawing debris from an area to be cleaned and vortex means for generating at least one vortex to dislodge debris while keeping the dislodged debris within easy range of that portion of the nozzle means withdrawing debris. According to one aspect of the invention, the vortex generating means comprises at least one vortex nozzle energized by a compressed air line for directing a vortex downward ahead of the area then being cleaned by the nozzle means. When vortex generating means are compressed air nozzles, a cupped plate can be attached to the exit of said nozzles to create a high pressure region below said plate for support of the nozzle above the ground, thus producing the correct spacing from the ground. According to another aspect of the invention, vortex generating means are short airfoils ahead of the area being cleaned so that air drawn across the airfoils in response to the vacuum action of the nozzle means creates at least one vortex. Preferably there are a plurality of vortex generating means along a long side of the nozzle.

The nozzle means is typically a suction nozzle having an outlet and an inlet defined by a circumferential wall extending toward a surface to be cleaned. The vortex generating means is adjacent to a portion of the circumferential wall which separates the vortex generating means from the suction nozzle inlet and produces at least one vortex having a vortex filament flowing from the vortex generating means along and generally parallel to the surface to be cleaned across the gap between the surface to be cleaned and the circumferential wall portion to the inlet for loosening debris that may then be withdrawn from the surface through the suction nozzle means which is completely outside the space occupied by the vortex generating means.

Numerous other features, objects and advantages of the invention will become apparent from the following specification when read in connection with the accompanying drawing in which:

DETAILED DESCRIPTION OF PREFERRED EMBODIMENTS

Figure 1:
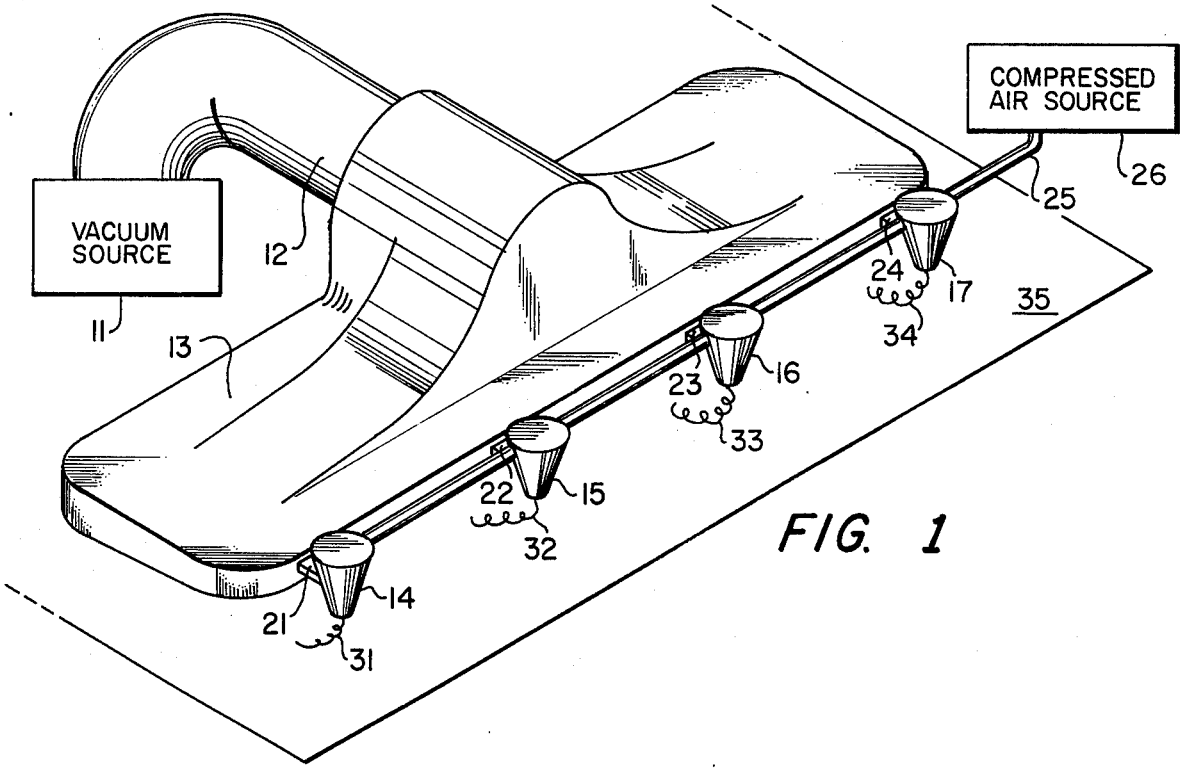
FIG. 1 is a combined block-pictorial representation of a system according to the invention using vortex nozzles powered by compressed air.

With reference now to the drawing and more particularly FIG. 1 thereof, there is shown a combined pictorial-block diagram of a vacuum cleaning system according to the invention. A vacuum source 11 is connected by hose 12 to suction nozzle 13. Vacuum source 11 may comprise the usual blower and bag or other means for storing debris gathered by suction nozzle 13 and is not a part of this invention. Suction nozzle 13 carries four downwardly pointing vortex nozzles 14–17 supported ahead of nozzle 13 by mounting struts 21–24, respectively, and fed with compressed air through hose 25 from compressed air source 26 to produce the vortex filaments 31–34, respectively, which impinge on surface 35 being cleaned.

Figure 2:
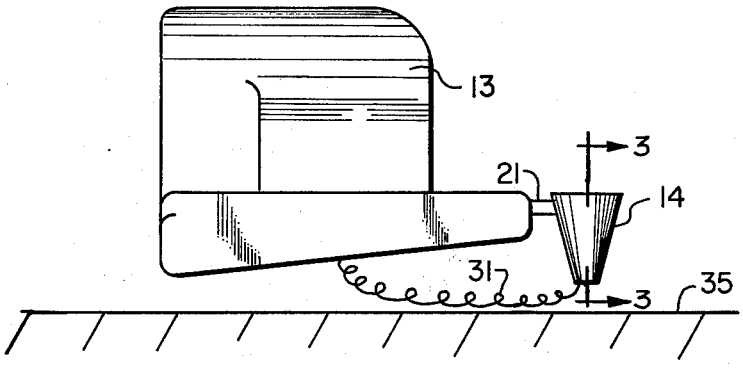
FIG. 2 is a side view illustrating the relationship between the suction nozzle, vortex nozzles and area being cleaned.

Referring to FIG. 2, there is shown a side view of suction nozzle 13, vortex nozzle 14, mounting struts 21, vortex filament 31 and surface area 35 illustrating how vortex 31 curls downward along surface 35 and back up into nozzle 13 to produce a vortex that is effective in dislodging debris and moving the dislodged debris into the suction stream of suction nozzle 13.

Figure 3:
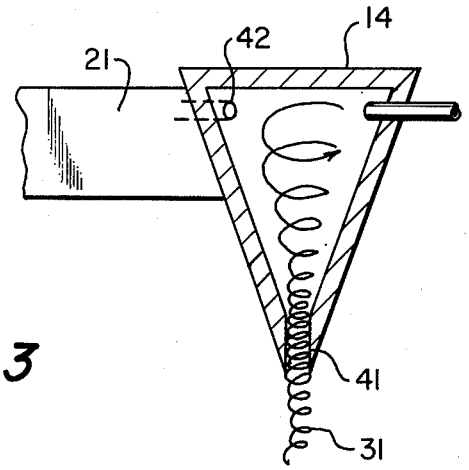
FIG. 3 is a longitudinal section view through a vortex nozzle.

Referring to FIG. 3, there is shown a view through section 3—3 of FIG. 2 to illustrate how the vortex is formed. Vortex nozzle 14 (and the others) is a hollow cone closed at the wide top and formed with an exit orifice 41 at the narrow bottom. Compressed air enters through tangential air inlet 42 to produce a stream of air of progressively decreasing diameter and increasing swirling velocity while moving downwardly to exit orifice 41.

Figure 4:
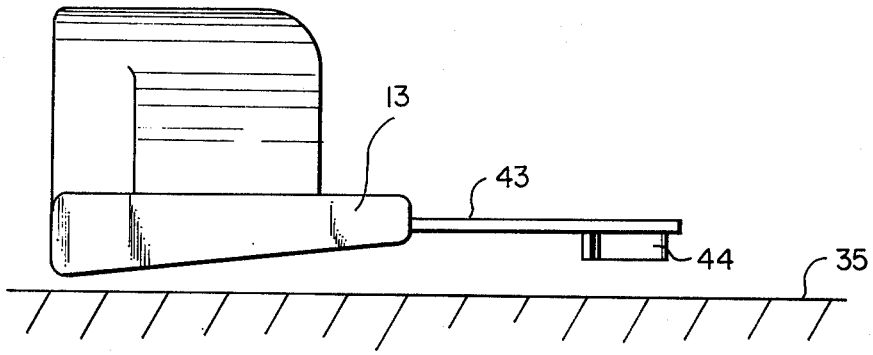
FIG. 4 is a side view of the embodiment of the invention using airfoils.
Figure 5:
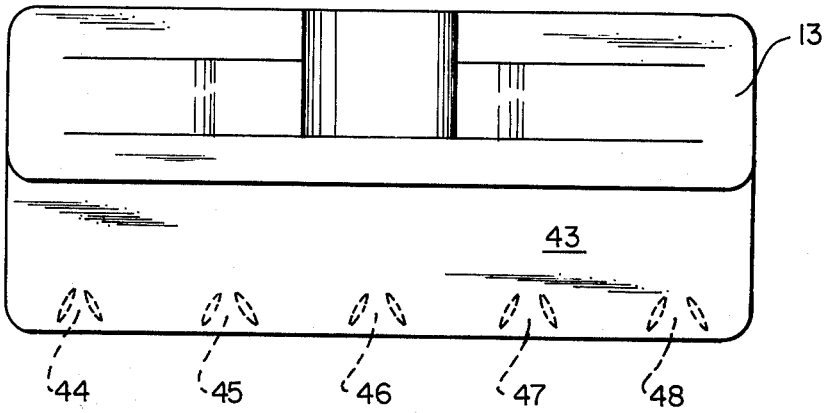
FIG. 5 is a top view of a nozzle having a front plate with depending airfoils.

Referring to FIG. 4, there is shown another embodiment of the invention in which suction nozzle 13 carries a forward horizontal plate 43 with depending airfoils, such as 44, at alternate positive and negative angles of attack so that the tip vortices created pass along the surface 35 drawn by the suction of the nozzle 13. Referring to FIG. 5, there is a top view of the embodiment of FIG. 4 illustrating airfoils 44–48 shown in invisible lines. This embodiment of the invention operates without a source of compressed air and may be suitable for a home vacuum cleaner. Nozzle 13 might then ride on wheels, rollers or slides, or without them as shown.

Figure 6:
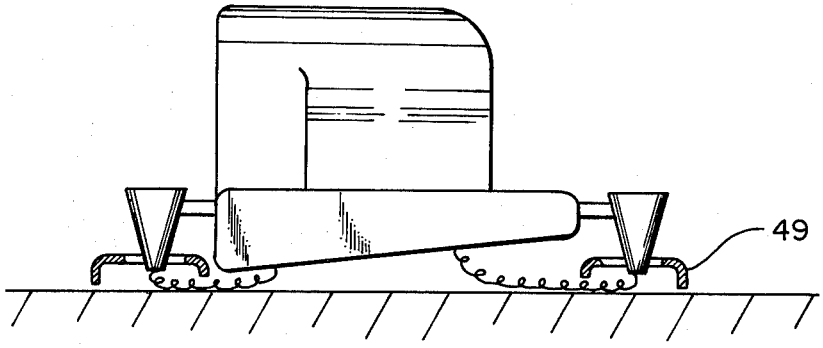
FIG. 6 is a side view of a nozzle using compressed air vortex nozzles with cupped air cushion support plates (49) to provide a high pressure region for support of the nozzle above the surface being cleaned.

Still another feature of the invention is that the high pressure used to create vortices may form an air cushion when confined with cupped support plate 49 upon which nozzle 13 may ride thus maintaining proper spacing of the nozzle from the surface being cleaned. (FIG. 6)

It is preferable that the vortex nozzles be so sized that the total flow of copressed air to all the vortex nozzles 21–24 be a small fraction, preferably 1–20%, of the main suction air flow. The diameter of exit orifice 41 should be sufficiently large so that the average axial velocity of exit through the orifice is close to the velocity of the suction air flow by the nozzle. Otherwise, the axial slowing required to join the suction air flow may cause radial growth and subsequent weakening of the vortex; that is, reduction of the tangential velocity. Since in the swirling flow of the vortex being generated, the centrifugal force is balanced by a radial pressure gradient, there will be a limit on the swirling (azimuthal) velocity which can be balanced by the atmospheric pressure. If this velocity is exceeded, the vortex will break down immediately outside the acceleration cone, thereby preventing the desired entrainment of the vortex between the nozzle and the area being cleaned.

The airfoils 44–48 may be generally of the type used on aircraft wings to generate vorticity as a means of delaying or preventing boundary layer separation. This embodiment of the invention ordinarily provides vortices of less intensity, smaller size and less swirling energy.

The invention is useful for household vacuum cleaners in performing the function of a brush driven by an auxiliary motor for loosening embedded soil. The invention is also expecially useful for cleaning railway tracks, subway tunnels or other areas too uneven to permit proper operation of a brush. The invention avoids wear because the suction nozzle never need touch the surface being cleaned.

A further advantage of the invention is that by regulating the position of the vortex nozzles 14–17 ahead of suction nozzle 13 and the exit velocity of the air, the invention may clean at an appreciable distance from the suction nozzle plane, such as beneath railway rails, curbstones or recessed niches in subway tunnels.

For improved performance in places like subway tunnels and railway tracks, it may be advantageous to automatically position the nozzle with a conventional pneumatic or hydraulic servo system that maintains a constant separation between the nozzle and the surface being cleaned. This servo system may include direct normal inputs for receiving particular positions designated by the operator for automatic holding or, alternatively, to allow manual maneuvering of the nozzle into areas not programmed into the automatic system. Servo systems capable of producing this result are known in the art, not a part of this invention and not further described here to avoid obscuring the principles of the invention.

There has been described novel apparatus and techniques for providing improved vacuum cleaning with reduced wear and ease of operation over a wide variety of surfaces. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In vacuum cleaning apparatus having a source of vacuum and suction nozzle means having an outlet and an inlet defined by a circumferential wall extending toward a surface to be cleaned for withdrawing debris from a surface to be cleaned the improvement comprising, vortex generating means adjacent to a portion of said circumferential wall which separates said vortex generating means from said suction nozzle inlet means for producing at least one vortex having a vortex filament flowing from said vortex generating means along and generally parallel to the surface to be cleaned through the gap between the surface to be cleaned and said circumferential wall portion of said inlet for loosening debris that may then be withdrawn from said surface through said nozzle means which is completely outside the space occupied by said vortex generating means.

2. The improvement in accordance with claim 1 wherein said vortex generating means comprises, vortex nozzle means for initiating said at least one vortex, and means for supporting said vortex nozzle means for directing a vortex towards the surface to be cleaned.

3. The improvement of claim 2 and further comprising, a source of compressed air, and means for coupling said source of compressed air to said vortex nozzle means.

4. The improvement in accordance with claim 3 wherein said nozzle means comprises a hollow cone closed at the wide top and open at the narrow bottom and having a tangential air inlet for receiving said compressed air.

5. The improvement in accordance with claim 3 wherein the total flow of compressed air to said vortex nozzle means is within 1–20% of the main suction air flow passing through said suction nozzle means.

6. The improvement in accordance with claim 2 and further comprising spacing means coupled to said apparatus for riding on the surface to be cleaned and establishing a predetermined spacing between said suction nozzle means and the surface to be cleaned.

7. The improvement in accordance with claim 6 wherein said spacing means comprises a cupped support plate depending from said vortex nozzle means.

8. The improvement in accordance with claim 1 wherein said vortex generating means comprises airfoils, at incidence to the stream of air flowing towards said inlet, depending from supporting structure attached to said suction nozzle means for producing tip vortices lying generally parallel to the surface being cleaned moving toward said suction nozzle means.

9. A method of vacuum cleaning which method includes the steps of, establishing a moving air stream across a surface being cleaned toward an opening in suction nozzle means, and establishing at least one vortex in a vortex generating area in said stream haing a vortex filament flowing from a point in said area which is completely outside the space occupied by said suction nozzle means along and generally parallel to said surface being cleaned to the opening in said suction nozzle means for helping to dislodge debris and freeing the dislodged debris for flow to said suction nozzle means in said stream, said space occupied by said suction nozzle means being completely outside said vortex generating area.

10. The improvement in accordance with claim 1 and further comprising spacing means coupled to said apparatus for riding on the surface to be cleaned and establishing a predetermined spacing between said suction nozzle means and the surface to be cleaned.

* * * * *